US010044147B2

(12) United States Patent
Listing et al.

(10) Patent No.: US 10,044,147 B2
(45) Date of Patent: Aug. 7, 2018

(54) SLOTTED SHIELD

(71) Applicants: Tyco Electronics AMP GmbH, Bensheim (DE); Tyco Electronics Corporation, Berwyn, PA (US)

(72) Inventors: Martin Listing, Langen (DE); David James Rhein, Memphis, MI (US)

(73) Assignees: TE Connectivity Corporation, Berwyn, PA (US); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/812,202

(22) Filed: Jul. 29, 2015

(65) Prior Publication Data

US 2015/0333449 A1 Nov. 19, 2015

Related U.S. Application Data

(63) Continuation of application No. PCT/US2014/014142, filed on Jan. 31, 2014.

(51) Int. Cl.

| | |
|---|---|
| ***H01R 9/03*** | (2006.01) |
| ***H01R 13/6581*** | (2011.01) |
| ***H01R 13/533*** | (2006.01) |
| ***H01R 13/6582*** | (2011.01) |

(52) U.S. Cl.

CPC ..... *H01R 13/6581* (2013.01); *H01R 13/533* (2013.01); *H01R 13/6582* (2013.01)

(58) Field of Classification Search

CPC ..... H01R 13/648; H01R 13/6593; H01R 13/6581

USPC ..... 439/607.55

See application file for complete search history.

(56) References Cited

U.S. PATENT DOCUMENTS

| | | | | |
|---|---|---|---|---|
| 4,544,227 | A | 10/1985 | Hirose | |
| 5,389,025 | A | 2/1995 | Vanceulen et al. | |
| 5,810,620 | A | 9/1998 | Kobayashi et al. | |
| 5,961,351 | A * | 10/1999 | Wu | H01R 13/6581 439/607.45 |
| 6,250,942 | B1 | 6/2001 | Lemke et al. | |
| 7,425,155 | B2 * | 9/2008 | Takeuchi | H01R 9/032 439/607.01 |
| 8,784,136 | B2 * | 7/2014 | Siahaan | H01R 13/6581 439/607.41 |
| 2009/0318009 | A1 | 12/2009 | McCauley et al. | |

(Continued)

FOREIGN PATENT DOCUMENTS

| | | | |
|---|---|---|---|
| DE | 102006001102 | A1 | 7/2007 |
| EP | 0403010 | A1 | 12/1990 |
| EP | 0518431 | B1 | 8/1995 |

(Continued)

OTHER PUBLICATIONS

Abstract of JPS6313238(A), dated Jan. 20, 1988, 1 page.

(Continued)

*Primary Examiner* — Abdullah Riyami
*Assistant Examiner* — Nader Alhawamdeh
(74) *Attorney, Agent, or Firm* — Barley Snyder

(57) ABSTRACT

A shield for an electrical connector is provided and includes a first member, a second member, a slot, and a bridge. The slot is positioned between the first member and the second member. The bridge extends transverse across the slot and connects the first member with the second member.

18 Claims, 9 Drawing Sheets

(56) References Cited

U.S. PATENT DOCUMENTS

2010/0093212 A1 4/2010 Ho

FOREIGN PATENT DOCUMENTS

| | | | |
|---|---|---|---|
| EP | 1914841 | A1 | 4/2008 |
| GB | 2257576 | A | 1/1993 |

OTHER PUBLICATIONS

PCT Notification Concerning Transmittal of International Preliminary Report on Patentability, Intl App. No. PCT/US2014/014142, dated Aug. 13, 2015, 1 page.
PCT International Preliminary Report on Patentability, Intl App. No. PCT/US2014/014142, dated Aug. 4, 2015, 7 pages.
PCT Notification, Written Opinion of the International Searching Authority and International Search Report, International Application No. PCT/US2014/014142, dated Apr. 14, 2014, 11 pages.

* cited by examiner

SLOTTED SHIELD

CROSS-REFERENCE TO RELATED APPLICATION

This application is a continuation of International Patent Application No. PCT/US2014/014142 filed Jan. 31, 2014, which claims priority under 35 U.S.C. § 119 to U.S. Provisional Patent Application No. 61/758,993 filed Jan. 31, 2013.

FIELD OF THE INVENTION

The invention is generally related to an electrical connector and, more specifically, to an electrical connector with a slotted shield.

BACKGROUND

Magnetic shields are often used to prevent extraneous magnetic fields from affecting display tubes.

For instance, Japanese Patent Application JP-88/13238 generally discloses a known shield having two parts separately secured to a supporting frame of a shadow mask. The facing ends of the parts are connected together by strips of frit glass or a similar material.

European Patent Application EP0518431 generally discloses another known magnetic shield that includes two complementary magnetic members positioned a distance from each other. Electron beams generated in a display tube are thus shielded from external magnetic fields, such as the earth's magnetic field. The level of magnetic shielding can be optimized by adjusting the distance between the two magnetic parts.

Known shielded electrical connectors are typically used in electromagnetically (EM) active environments. Examples of these environments include connections between two or more legs of a power or signal line, where the presence and consequent effects of an active EM-field (EMF) may be undesirable. Known shielded electrical connectors are employed to protect an external environment from the EMF generated within the connector, or to protect the internals of the connector from an external EMF.

Typically, in order to properly shield a connector housing, the connector and the complementary mating connector both have a shield member, i.e. made of a metallic conductive material, and both shield members contact and overlap with each other in order to achieve mechanical and electrical continuity, thereby achieving the shielding effect.

Static environments are less demanding on the shield as compared to non-static environments in which the connector housing may be subjected to movements and vibrations. In non-static or vibrating environments, the shield components may rub against each other when there are two parts separately secured to different 'anchor' locations in contact. The resulting abrasion between the shield components often produces metallic remnants such as a powder or shards/slivers. The metallic remnants can compromise the electrical separation of the shield by connecting the shield to a 'live wire' that may cause a short circuit, or can create electrical connections between other locations within the connector which might be undesirable and a cause for failure.

A further disadvantage of known shielded connectors in non-static environments is the ease in which the movement or vibrations are transmitted to other parts of the electrical circuit through the usually rigid shield. Movement or vibrations to other parts of the circuit can damage components incapable of functioning correctly in non-static environments. Prolonged exposure to such stresses can cause these components to prematurely fail.

Another disadvantage of known shielded connectors is that mechanical stress can be conducted through the shield to various locations where the shield is anchored to the connector, such as the location where the shield is crimped onto a cable. Over prolonged exposure, the mechanical stresses can cause the shield crimp to loosen and cause the shield crimp to fail altogether.

SUMMARY

It is therefore an object of the invention to provide a shield for an electrical connector that includes a first member, a second member, a slot, and a bridge. The slot is positioned between the first member and the second member. The bridge extends transverse across the slot and connects the first member with the second member.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
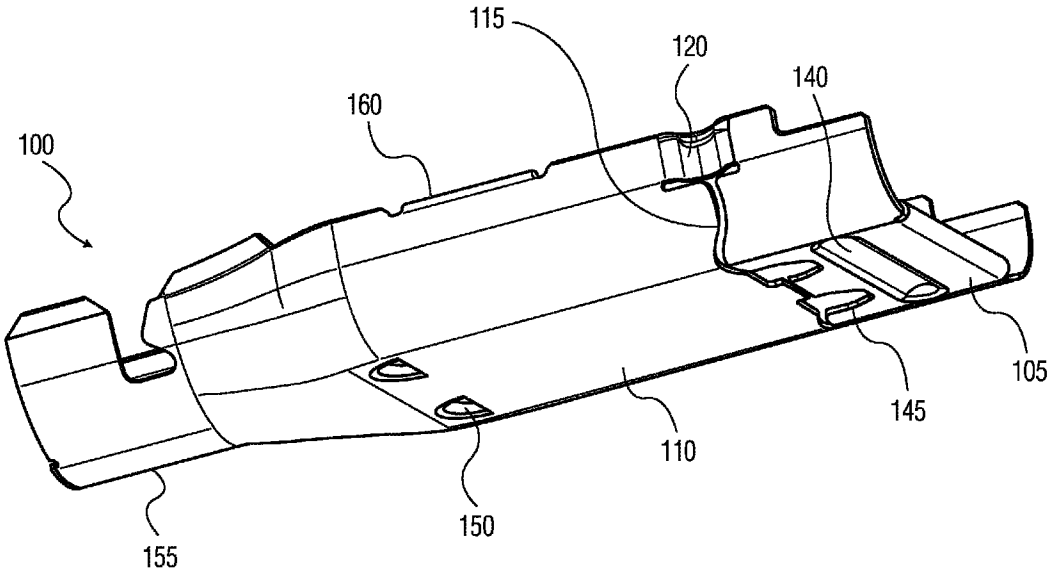
FIG. 1 is a perspective view from a shield according to the invention.

Now with reference to FIGS. 1 and 3, a shield 100 according to the invention will be described.

As shown, the shield 100 includes a first member 105 and a second member 110. The shield 100 is made from a thin sheet of conductive material, such as metal, that is stamped and then formed. The various features being described below can be stamped out of the thin sheet of conductive material, which may be metallic, an alloy, or any suitable electrically conductive material.

The first member 105 is positioned to make direct contact with a vibrating surface. A slot 115 is provided between the first member 105 and the second member 110 and extends substantially perpendicular to the longitudinal axis of the shield 100. A bridge 120 is also provided and connects the first member 105 to the second member 110. This bridge 120 provides flexibility and permits the first member 105 and the second member 110 to move with respect to each. In the shown embodiment, the bridge 120 is a comparatively thinner strip of conductive material than the rest of the shield 100.

The first member 105 can therefore be in contact with a vibrating surface, but due to the bridge 120, it is possible for the first member 105 to vibrate with the incoming vibrations to which it is exposed, without having the second member 110 subject to the same vibrations. The bridge 120 effectively dampens vibrations from carrying to the second member 110. As a result, the second member 110 experiences greatly reduced vibrations, if any. The bridge 120 can be formed as a U- or W- or Omega-shaped bend, or be a flat strip of material, alone or in combination, or utilize any of a number of well-known designs for dampeners for further improving its damping abilities.

In an exemplary embodiment, the first member 105 is not held rigidly against a vibrating surface. Rather, the second member 110 is secured to and statically in mechanical contact with the vibrating surface. The first member 105 is free to move along with the vibrating surface. The relative movement of the first member 105 with respect to the vibrating surface is greatly reduced in this embodiment. Additionally, the reduction in movement of the first member 105 provides an added advantage of greatly reduced frictional wear and tear because the contacting surfaces move less with respect to each other.

In another exemplary embodiment, the slot 115 may include a lock receiving passageway 145 that can be used to restrict the movement of at least one of the first member 105 and the second member 110 along the longitudinal axis (x-) or radially, perpendicular to the longitudinal axis (y- and z-). In an exemplary embodiment, the lock receiving passageway 145 may also be formed on at least one of the first member 105 and the second member 110 independent of the slot 115, and in other embodiments, the lock receiving passageway 145 may be formed on both the first member 105 and the second member 110. In another exemplary embodiment, a locking protrusion may extend at least partially through the lock receiving passageway 145, and abut the lock receiving passageway 145 to prevent any movement of the shield 100. Similarly, in another exemplary embodiment, a locking protrusion 150 may be provided on at least one of the first member 105 and the second member 110 for restricting movement of the shield in at least one of an axial or radial direction. In other exemplary embodiment, the locking protrusion 150 may be provided on both the first member 105 and the second member 110. The freedom of movement between the first member 105 and the second member 110 remains unchanged even when one or more of the lock receiving passageway 145 and the locking protrusion 150 are in use.

Figure 3:
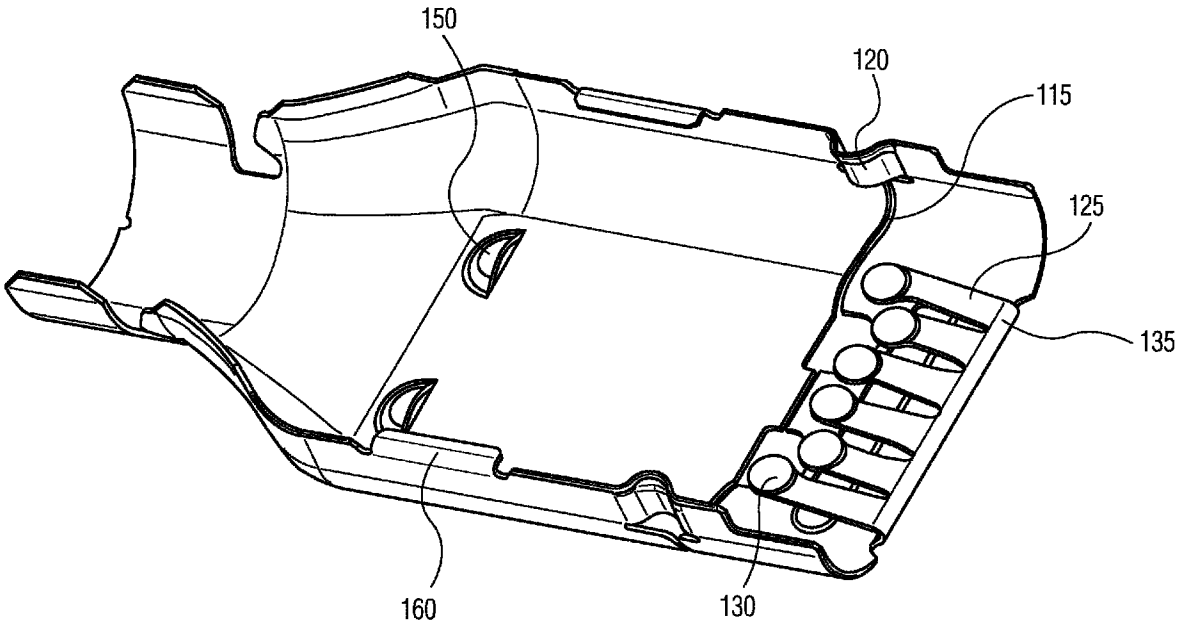
FIG. 3 is a bottom perspective view of the shield of FIG. 1.

As shown in FIG. 3, at least one of the first member 105 and the second member 110 may include an elastically deflectable contact arm 125 formed with the shield 100. In an exemplary embodiment, the shield 100 has a plurality of contact arms. The contact arms 125 have contacts 130 disposed on an end. The length of the contact arms 125 may vary, such that the contacts 130 are staggered with respect to each other. By varying the lengths of the contact arms 125, adjacent contacts 130 contact a counter contact surface at different distances from a leading edge 135 of the at least one of the first member 105 and the second member 110.

Figure 2:
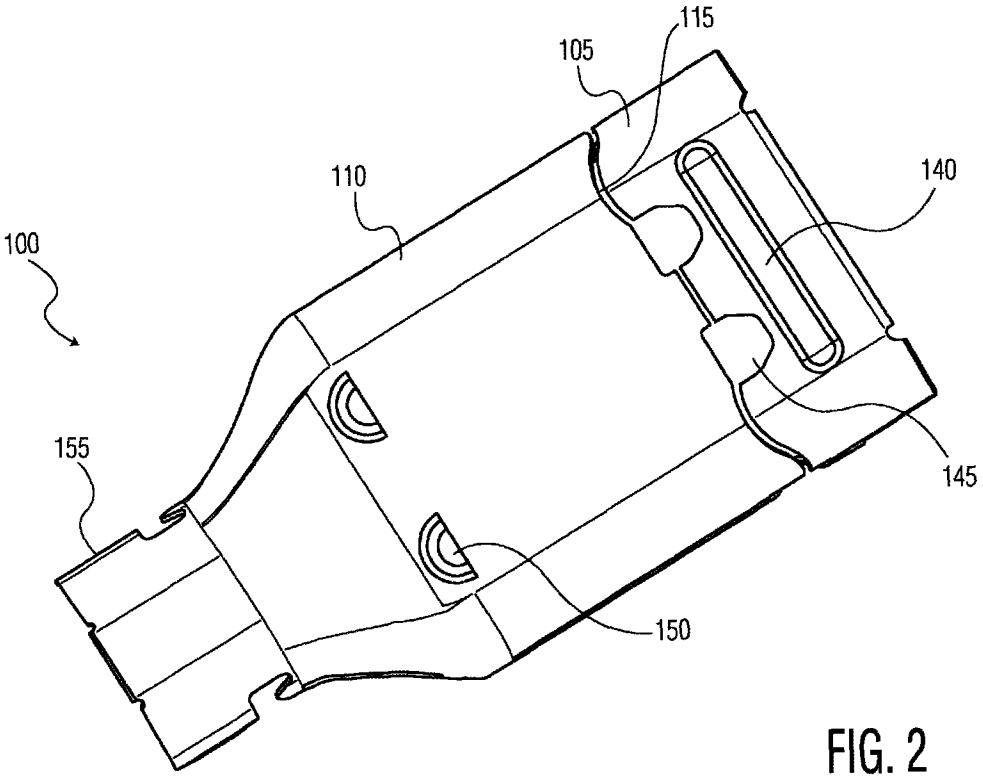
FIG. 2 is a top view of the shield of FIG. 1.

To ensure that the mechanical strength of elastically deflectable contact arms 125 is secure, a strengthening bead 140 is provided on at least one of the first member 105 and the second member 110 or on both members 105, 110 having the contact arms 125. The strengthening bead 140 reinforces the first member 105 or the second member 110, by increasing their mechanical strength to counter any mechanical strain placed on the members 105,110 by the elastic deformation of the contact arms 125. The strengthening bead 140 may be a corrugation of the thin sheet of conductive material forming the shield 100 as shown in FIG. 2, or in other embodiments may be formed by the addition or deposition of material. A variety of methods known by those of ordinary skill in the art can be used for fixing the additional material in place, such as welding (laser, ultrasonic, friction etc.), or soldering or any other appropriate method.

In an embodiment, the first member 105 or the second member 110 may include a securing member 155 for fixing the first member 105 or the second member 110 to a cable, or both members 105,110 to cables.

In one exemplary embodiment, the shield 100 is manufactured as two complementary halves, such that the complementary halves can be positioned to provide full electromagnetic shielding. Similarly, in another exemplary embodiment, the shield 100 is manufactured as a single part, where side edges can be brought together to form a box-like shield by bending the thin sheet of conductive material after it has been stamped in the appropriate design.

The shield 100 can further include a locking protrusion 160 to attach the first member 105 or the second member 110, or both members 105,110 to adjacent structures such as a connector housing.

In exemplary embodiment, the shield 100 has a bridge 120 that is at least partially bent inwards so that the first member 105 substantially surrounds the second member 110 to create a two-layered shield 100. In another exemplary embodiment, the bridge 120 may be partially bent outwards so that the second member 110 substantially surrounds the first member 105 to create a two-layered shield 100.

Figure 4:
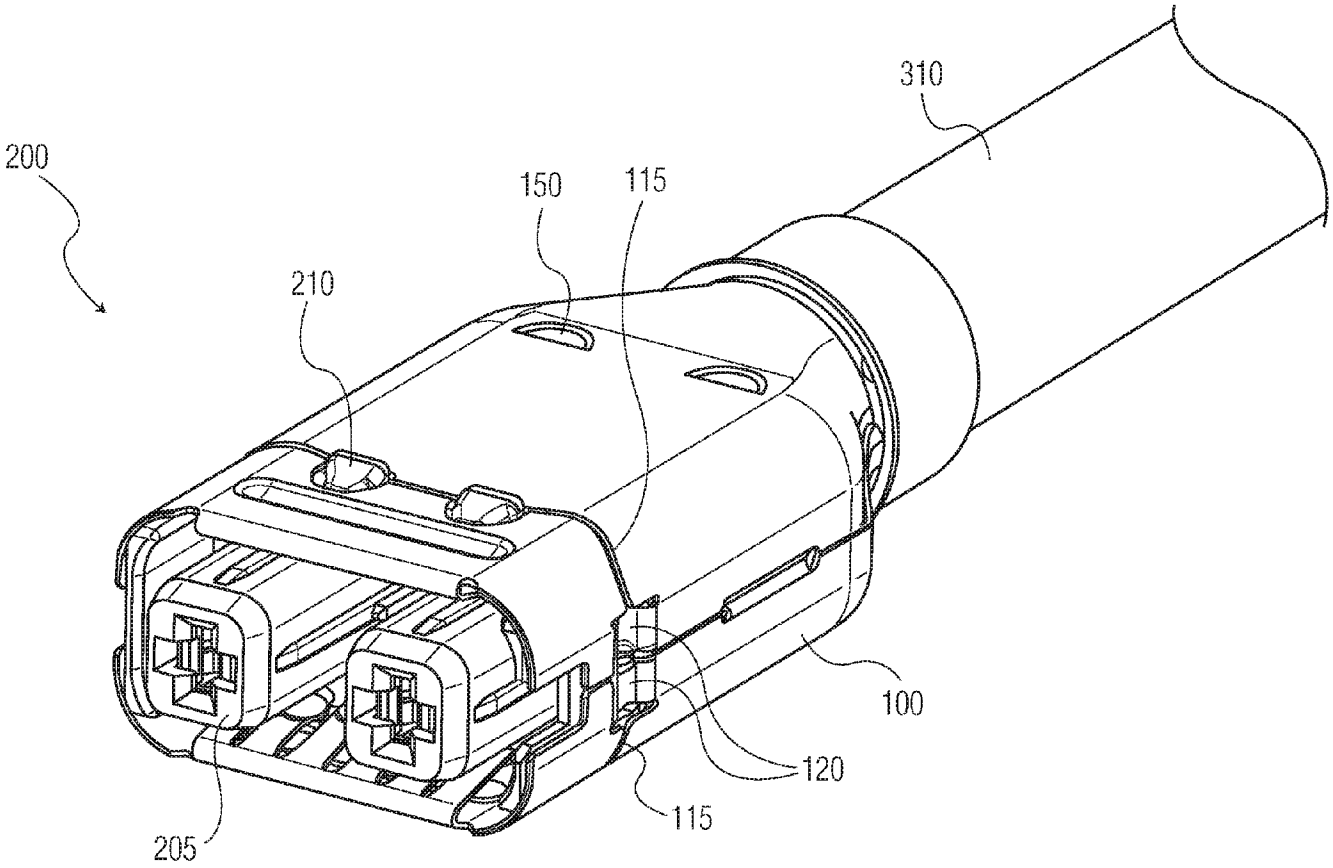
FIG. 4 is a perspective view of an electrical connector having a shield according to the invention.

With reference to FIG. 4, an electrical connector 200 according to the invention is shown that includes at least one connector housing 205 and a shield 100 as described above with reference to FIGS. 1-3 above. The shield 100 includes a first member 105 and a second member 110 that is formed in continuity with the first member 105, where the first member 105 is moveably connected to the second member 110 through at least one bridge 120, and is capable of moving relative to the second member 110. The electrical connector 200 is operable in high-vibration environments by reducing the wear and tear that the shield 100 experiences in such applications. There is a reduction in the relative motion of the first member 105 or the second member 110, whichever is in contact with a vibrating surface; with respect to the vibrating surface. Therefore, the wear and tear experienced by the first member 105 or the second member 110 rubbing against the vibrating surface is greatly reduced.

In an exemplary embodiment, the electrical connector 200 has a shield 100 formed from two complementary shield halves, as shown in FIG. 4. In another exemplary embodiment, the shield 100 is formed from a single sheet of thin conductive material that is stamped to form the features described above, and then is bent around itself so that its sides come into contact with each other to form a box-like structure that forms the shield 100.

In an exemplary embodiment, the shield 100 surrounds and connects to the connector housing 205 through one or more locking members discussed above, such as the lock receiving passageway 145 or the locking protrusion 150, which restricts the movement of the shield 100 with respect the connector housing 205. As shown in FIG. 4, a locking protrusion 210 is formed on the connector housing 205 and extends at least partially through the lock receiving passageway 145 and abuts the shield 100 to prevent movement of the shield 100 along the longitudinal axis. Similar functionality in the radial (y and z) or axial (x) directions is achieved in other embodiments by having the locking protrusion 150 abut the connector housing 205.

In an exemplary embodiment, the shield 100 surrounding the connector housing 205 has an additional external connector housing (not shown) to enable utilizing the electrical connector 200 in different locations and environments for a number of applications. The shield 100 may therefore be connected to a connector housing 205 positioned inside or outside of the shield 100 or to a second connector housing positioned on an outer surface of the shield 100.

Figure 5:
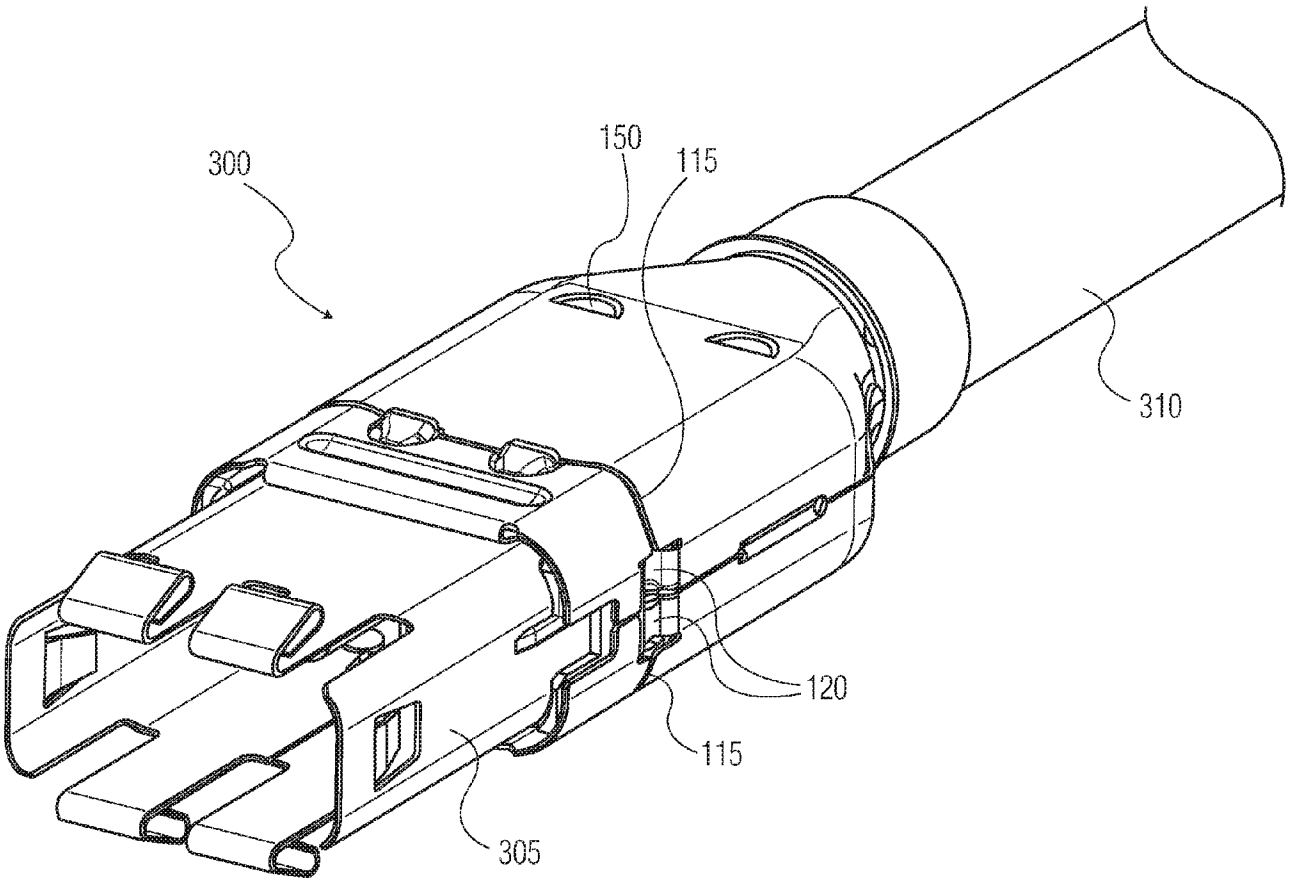
FIG. 5 is another perspective view of the electrical connector having the shield according to the invention.

With reference to FIG. 5, an assembly 300 having an electrical connector 200 and a complementary electrical connector is shown. The electrical connector 200 and the complementary electrical connector (not shown) have a shield apparatus.

The electrical connector 200 has a connector housing 205 and a shield 100, as has been described in connection with the preceding figures. The shield 100 has a first member 105 in contact with a vibrating surface; a second member 110 formed in continuity with the first member and separated from the first member by a slot 115, and a bridge 120 that connects the first member 105 with the second member 110. The shield 100 includes contacts 130 that contact a counter contact surface 305 of the shield of the complementary electrical connector when the electrical connector 200 and the complementary electrical connector are mated. See FIG. 5.

In an embodiment, the contacts 130 are staggered with respect to each other such that adjacent contacts 130 do not contact the counter contact surface at the same distance from a leading edge 135 of the at least one shield. This results in asymmetric contact of the contacts 130 with the counter contact surface 305, and prevents the counter contact surface 305 from becoming weakened along a straight line, which can become a source of mechanical failure of the shield of the complementary electrical connector.

The source of the vibrations being introduced into the assembly 300 can be from the complementary electrical connector as described above, or it can be from the end of the cable 310. The teachings of this invention can be applied to either case to achieve a stable and secure connection when subject to vibrations.

Figure 6:
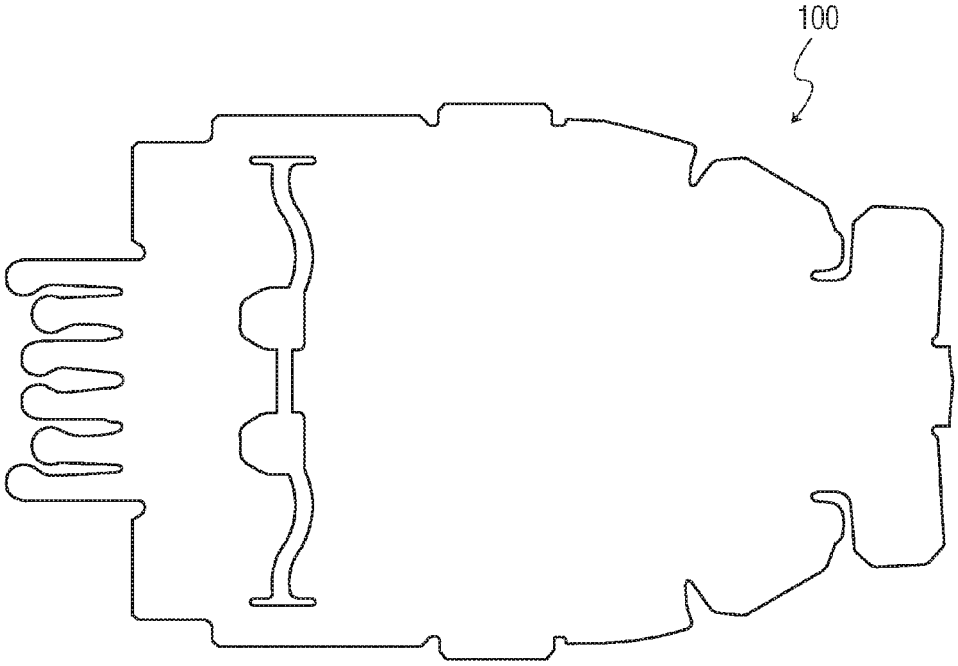
FIG. 6 is a top view of a blank for a shield according to the invention.

With reference to FIG. 6, a blank for a shield 100 according to the invention is shown. The thin sheet of conductive material is stamped in this design and thereafter bent into the desired shape to form the shield 100. This would result in the formation of 'halves' of the shield, and two such halves could be employed to achieve shielding as has been described above. It would be obvious to one of ordinary skill in the art, that to form the box-like embodiment of this invention, two such flattened out shapes can be stamped while leaving them connected to each other on the side, and thereafter the stamped sheet can be bent into shape.

Figure 7A:
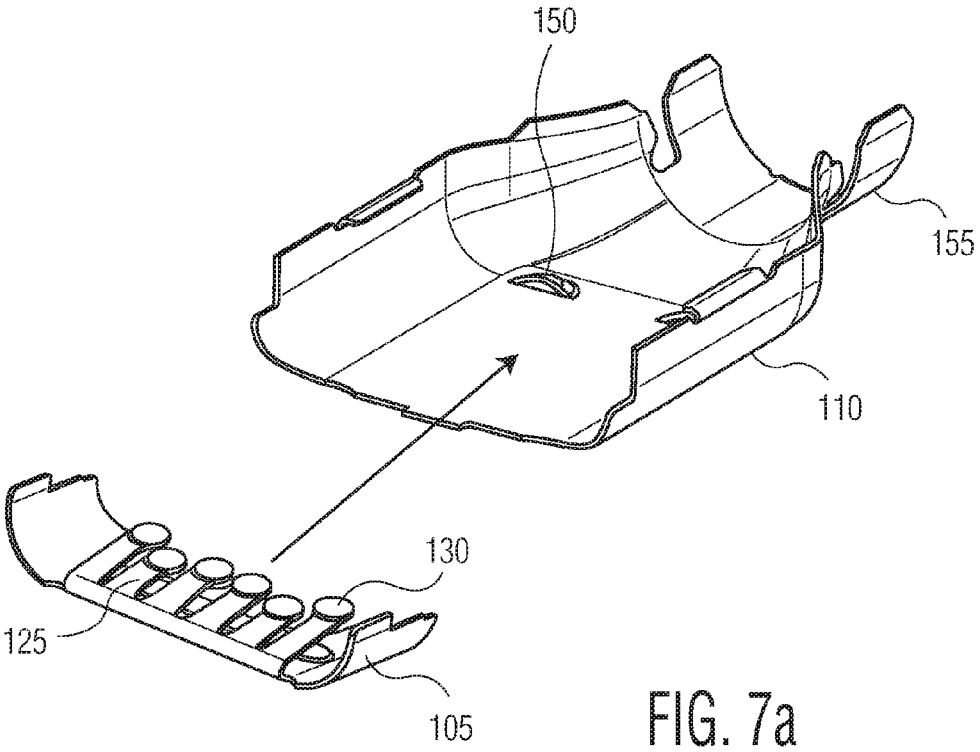
FIG. 7*a* is a perspective view of a first half for a two layered shield according to the invention.
Figure 7B:
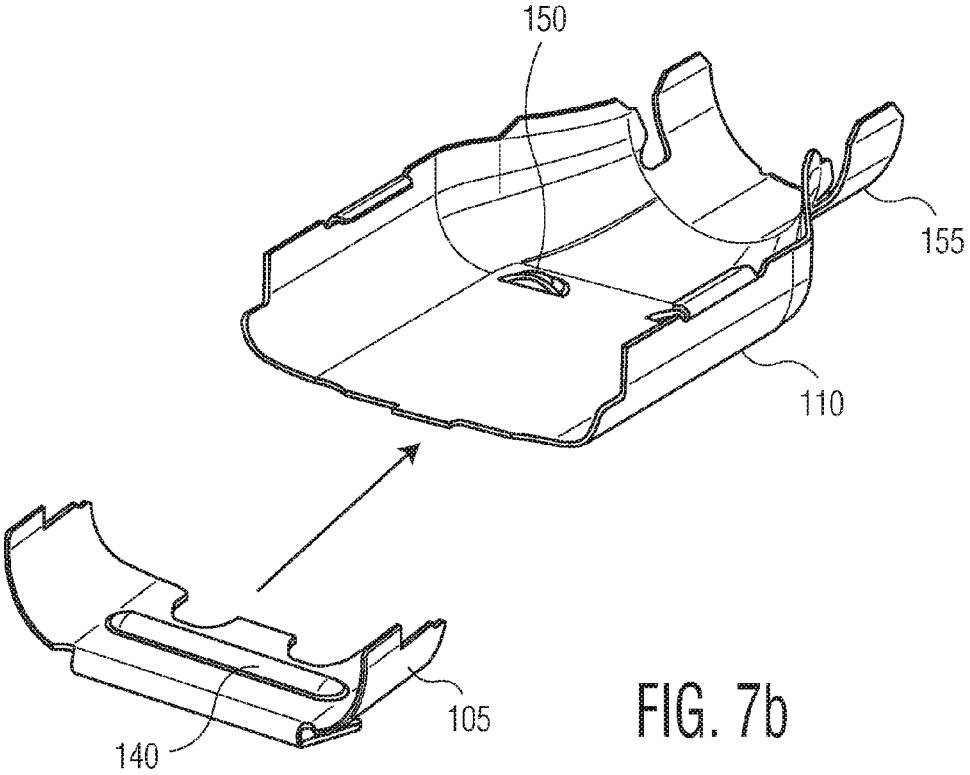
FIG. 7*b* is a perspective view of a second half for a two layered shield according to the invention.

With reference to FIGS. 7*a* and 7*b*, a shield 100 having a two layers is shown. It would be obvious to a person skilled in the art that if the smaller member shown in the figure is to be mounted outside of the larger member, then the contact arms 125 would have to be bent in the opposite direction to what is illustrated.

Figure 8:
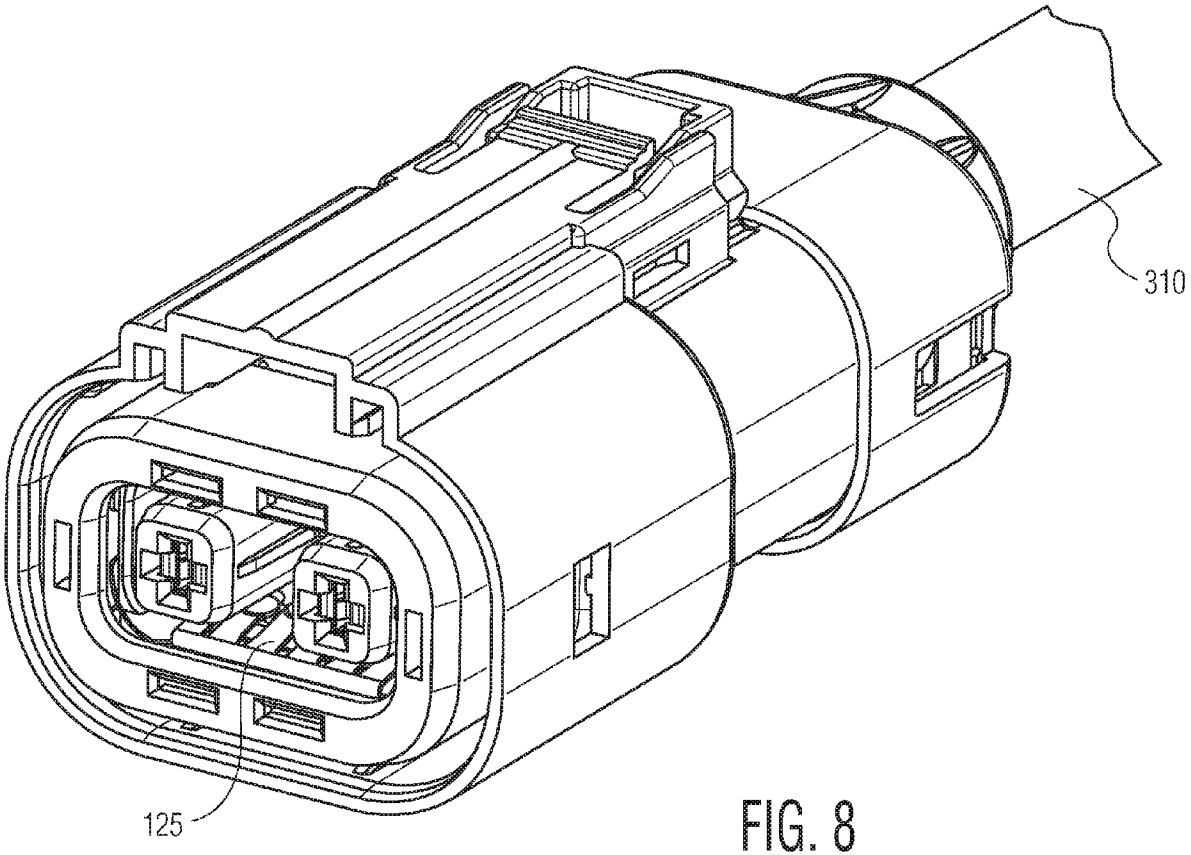
FIG. 8 is a perspective view of an electrical connector having a shield according to the invention.

As shown in FIG. 8, an electrical connector 200 is shown and includes a connector housing and a shield 100 according to the invention is shown. An outer connector housing is also provided in the embodiment shown.

Figure 9:
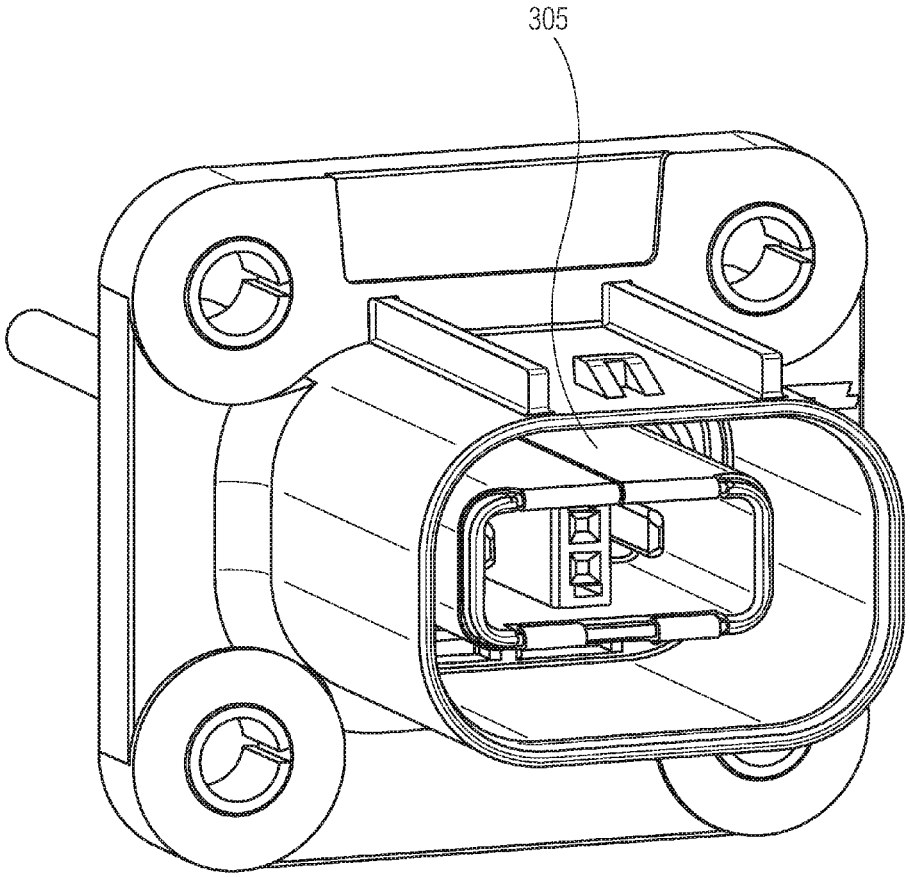
FIG. 9 is a perspective view of a mating electrical connector for the electrical connector of FIG. 8.

With reference to FIG. 9, a mating electrical connector 305 is shown and is to mate with electrical connector having a shield 100 according to the invention.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A shield for an electrical connector, comprising:
- a first member;
- a second member;
- a slot positioned between the first member and the second member, and
- a bridge connecting and integrally formed with the first member and the second member and extending transverse across the slot, the first member independently moves with respect to the second member.

2. The shield according to claim 1, wherein the slot includes a lock receiving passageway.

3. The shield according to claim 1, wherein the bridge includes a U-shaped bend, a W-shaped bend, an Omega-shaped bend, or a flat strip.

4. The shield according to claim 1, wherein the first member or the second member includes a plurality of elastically deflectable contact arms, each of the plurality of elastically deflectable contact arms having a contact disposed on an end thereof.

5. The shield according to claim 4, wherein adjacent contacts of the plurality of elastically deflectable contact arms are staggered with respect to each other such that the adjacent contacts extend different distances from a leading edge of the first member or the second member.

6. The shield according to claim 4, further including a strengthening bead disposed along the first member or the second member.

7. The shield according to claim 1, wherein the shield is a stamped and formed sheet of conductive material.

8. The shield according to claim 1, wherein the first member or the second member further includes a locking protrusion.

9. The shield according to claim 1, wherein the first member or the second member further comprises a securing member extending from the first member or the second member.

10. An electrical connector comprising:
- a connector housing; and
- a shield surrounding the connector housing and having:
  - a first member,
  - a second member integrally formed with the first member and being independently moveable relative to the first member:
  - a slot disposed between the first member and the second member; and
  - a bridge positioned in the slot, the bridge integrally formed with the first member and the second member and connecting the first member and the second member.

11. The electrical connector according to claim 10, wherein the first member is movably connected to the second member.

12. The electrical connector according to claim 10, wherein the shield includes a pair of complementary shield halves.

13. The electrical connector according to claim 10, wherein the first member or the second member are connected to the connector housing.

14. The electrical connector according to claim 10, wherein the first member or the second member further includes a locking member engageable with the connector housing.

15. The electrical connector according to claim 10, wherein the first member or the second member further includes a strengthening bead disposed a long a surface thereof.

16. An assembly comprising:

an electrical connector having:

a connector housing; and a pair of shields surrounding the connector housing, each shield covering a portion of the connector housing and having:

a first member;

a second member, a slot positioned between the first member and the second member, a bridge connecting and integrally formed with the first member and the second member, the first member independently moves with respect to the second member; and a plurality of contacts extending from the first member;

a mating electrical connector corresponding to the connector housing; and a shield apparatus contactable with the plurality of contacts.

17. The assembly according to claim 16 wherein adjacent contacts of the plurality of contacts are staggered with respect to each other such that the adjacent contacts extend at various distances from a leading edge of the shield.

18. A shield for an electrical connector, comprising:

a body having a fixed section and a free section positioned opposite the fixed section;

a slot positioned between the fixed section and the free section; and a bridge connecting and integrally formed with the fixed section and the free section, the free section independently moves with respect to the fixed section, a longitudinal direction of the bridge extending transverse across the slot and parallel to a longitudinal direction of the body.

* * * * *